US006508844B1

(12) United States Patent
De Boos et al.

(10) Patent No.: US 6,508,844 B1
(45) Date of Patent: Jan. 21, 2003

(54) METHOD FOR IMPROVING THE STABILITY OF THE SHAPE OF TROUSERS

(75) Inventors: Allan Gibson De Boos, Newtown (AU); Andrew Morgan Wemyss, Belmont (AU); Keith William Fincher, Drysdale (AU)

(73) Assignees: Commonwealth Scientific and Industrial, Campbell (AU); Research Organisation, Territory (AU)

( * ) Notice: Subject to any disclaimer, the term of this patent is extended or adjusted under 35 U.S.C. 154(b) by 0 days.

(21) Appl. No.: 09/424,216

(22) PCT Filed: May 19, 1998

(86) PCT No.: PCT/AU98/00372

§ 371 (c)(1),
(2), (4) Date: Jan. 19, 2000

(87) PCT Pub. No.: WO98/52432

PCT Pub. Date: Nov. 26, 1998

(30) Foreign Application Priority Data

May 20, 1997 (AU) ..... PO 6904

(51) Int. Cl.[7] ..... D06M 0/00

(52) U.S. Cl. ..... 8/137; 2/227; 2/242; 8/142; 8/147

(58) Field of Search ..... 2/227, 242; 8/137, 8/142, 147

(56) References Cited

U.S. PATENT DOCUMENTS

| | | | | | |
|---|---|---|---|---|---|
| 3,731,411 | A | * | 5/1973 | Barber et al. | 38/144 |
| 3,985,502 | A | * | 10/1976 | Boorujy et al. | 8/137 |
| 4,555,814 | A | * | 12/1985 | Sears et al. | 2/227 |
| 5,614,591 | A | * | 3/1997 | Basinger et al. | 525/163 |
| 5,774,892 | A | * | 7/1998 | Tisdale et al. | 2/69 |
| 5,926,851 | A | * | 7/1999 | Kavalic | 2/227 |

FOREIGN PATENT DOCUMENTS

| | | | |
|---|---|---|---|
| DE | 2 017 394 | A | 10/1971 |
| EP | 0024336 | A | 3/1981 |
| EP | 156743 | A | 10/1985 |
| EP | 0283137 | A | 9/1988 |
| SE | 7807028 | A | 1/1979 |

* cited by examiner

*Primary Examiner*—Yogendra N. Gupta
*Assistant Examiner*—D G Hamlin
(74) *Attorney, Agent, or Firm*—Sughrue Mion, PLLC

(57) ABSTRACT

A method for improving the stability of the shape of trousers (10) subjected to treatment with a fluid. During the treatment, the inside **(12*b*) and outside (12*a*) of each leg (12) of the trousers are attached, at locations on the respective legs which are on or adjacent the crotch (16)** of the trousers. Attachment may be by means of a mechanical.

37 Claims, 3 Drawing Sheets

METHOD FOR IMPROVING THE STABILITY OF THE SHAPE OF TROUSERS

BACKGROUND OF THE INVENTION

This invention relates to a method for improving the stability of the shape of trousers.

To be considered machine washable or "easycare", garments not only have to maintain their dimensions after washing and tumble drying but must also retain their shape. The flat areas and seams of the garment should appear flat after washing and drying and creases should remain sharp. In garments composed of cotton or regenerated cellulose for example viscose, rayon and blends of these fibres with for example polyester, this is commonly achieved by pretreating the fabric with a resin which is cross-linked (cured) after the garment has been made and formed. Wool garments can be given an easycare treatment by the application of a polymer from solvent and subsequent curing and setting. For garments containing more than 40% polyester a hot head press may be used but this is only useful on accessible parts of the garment and often caues distortions at the interface between the pressed and un-pressed areas and may also lead to some discolouration.

SUMMARY OF THE INVENTION

In one aspect, the invention provides a method for improving the stability of the shape of partly or fully formed trousers subjected to a process including treatment with a medium wherein, during at least part of the process the inside and outside of at least one leg of the trousers are attached at a location on or adjacent the crotch of the trousers. The medium may be a solvent, gas, steam or water, and my be in fluid form. The process may include subjecting the trousers to uncontrolled movements tending to cause the trousers to lose shape.

The process may include drying, such as tumble drying, the trousers. The attaching preferably prevails at least during a substantial part of the time during which the trousers are subjected to drying. The location at which attachment is effected may be within 20 cm of the crotch, preferably within 10 cm of the crotch. The location may be on a partition seam of the trousers defining the crotch. The location may be substantially midway between opposed creases of said at least one leg. The location is substantially on a side seam of said at least one leg.

The attachment may be effected by use of attachment means which is positioned on the trousers. The attachment means may be positioned on the trousers prior to subjecting the trousers to said treatment or after subjecting the trousers to said treatment. The attachment means, or at least a component thereof, may be attached before said process is effected and removed subsequently.

The inside and outside of the at least on leg of the trousers may be attached only at said location. Alternatively, the inside and outside of the at least one leg may be attached at a further location, spaced away form the crotch region.

The process with which the invention is used may include laundering or washing the trousers, or may include a process in manufacture of the trousers.

Following said process or following said treatment, the trousers may be treated with a chemical after-treatment for improving stability of the shape of the trousers.

The trousers may be subjected to pressing after or during said process.

The attaching may be released after said pressing. Alternatively, the attaching may be released before said pressing.

Attaching may be provided by substantially permanently affixed attachment means, or by removable attachment means. The attachment means may act internally of the trousers and/or externally.

The inside and outside of each of two legs of the trousers may be attached, during at least part of said process, at respective said locations. In this case, the locations may be aligned. The attaching may then be effected by an attachment means which comprises a single attachment device which attaches the inside and outside of each leg. The trousers may be formed from fibrous materials. Such material may include wool, cotton, silk, regenerated or other cellulosic fibres, or nylon, polyester or other synthetic fibres, or any blend of any one or more of these with other fibres. The trousers may be formed from material which softens under action of water, steam, solvent and/or heat. The trousers may be formed from one or more materials selected from the group comprising protein fibres, regenerated or othe cellulosic fibres, nylon, polyamide or other synthetic fibres. The material may include a substantial proportion of wool and/or cotton.

The invention also provides a method of laundering or washing trousers in which, during the laundering and washing, the trousers have applied thereto an attachment means which attaches the inside and outside of each leg of the trousers at a respective location on or adjacent the crotch of the trousers. During the laundering or washing, the inside and outside of each leg of the trousers may be attached at respective locations on or adjacent the crotch of the trousers. The attachment may be effected before the process and subsequently removed.

The invention also provides partly or fully formed trousers having the inside and outside of at least one leg of the trousers attached at a respective location on or adjacent the crotch of the trousers.

The invention also provides partly or fully formed trousers having attachment means for attaching the inside and outside of each leg of the trousers at respective locations on or adjacent the crotch of the trousers.

The invention further provides a method for improving the stability of the shape of a garment of the kind having a generally tubular part appendant to another region of the garment and which garment is subjected to a process including treatment with a medium wherein, during at least part of the process, opposed wall portions of the generally tubular part are attached to each other at a location adjacent to the junction between the tubular part and the another region. The tubular part may have opposed lengthwise creases between which the opposed portions extend.

Surprisingly, it has been found that by adoption of methods in accordance with the invention, a stabilisation effect can be achieved so far as the shape of the trousers is concerned. Thus, in embodiments of the present invention a level of permanent set, preferably in excess of 30% permanent set, (retention of a measured crease angle of 126° after release in water at 50° C.) is conventionally imparted to the creases and seams, and a mechanical device is inserted into the garment to hold it in the required shape during washing and subsequent drying. In the absence of any permanent set imparted to the garment, the use of the invention may still provide adequate shape retention, although creases may not be as sharp.

The attachment may be effective to hold the trousers in the required shape during laundering steps including washing and subsequent drying. For example, depending on the nature of fibres other than cotton or wool which are present, the method of the invention may include line and preferably tumble drying of the trousers.

The method of the invention may for example be applied by a manufacturer during processing of the trousers, and/or by the consumer during laundering of the trousers.

In one embodiment of the invention, the trousers are constrained at a single point in the area joining both legs, from the outside seams of the trousers through the partition seam at the crotch. Nevertheless attachments may additionally be provided at the waist, the cuffs and the legs, separately, such as at points along the seams.

In an embodiment of the invention the device is used in every laundering cycle, but it can also be used in processing treatments after garment setting which chemically stabilizes the set imparted in pressing. Such treatments include the application of resins in rotary machines whereby the use of the invention may minimise the pressing required after removing the garments from the machine. Also, the invention may be particularly advantageous for dyeing of all-wool and wool-rich trousers in rotary machines whereby the dyeing conditions also permanently set the trousers in the desired configuration imparted by practising the invention. Further applications are in the steam setting of all-wool and wool blend trousers, whereby steam is introduced into a rotary machine containing the tumbling trousers with the constraint in place. Practising of the invention in steam tumbling of trousers, by a dry cleaner or commercial laundry, may minimise or eliminate the operation of steam pressing.

The invention may also be used to improve shape retention of a garment previously washed without practising the invention.

The attachment means may comprise a pin such as a safety pin, press stud, bra stud, magnets, stud ear ring style, hook and loop style fasteners (eg material sold under the trademark VELCRO), plastic tags (traditionally used to fix tabs or labels to garments), adhesive or the like. Preferably, the means is removable or easily unfastened.

BRIEF DESCRIPTION OF THE DRAWINGS

The invention is further described, by way of example only, with reference to the accompanying drawings, in which.

DETAILED DESCRIPTION OF THE INVENTION

Figure 1C:
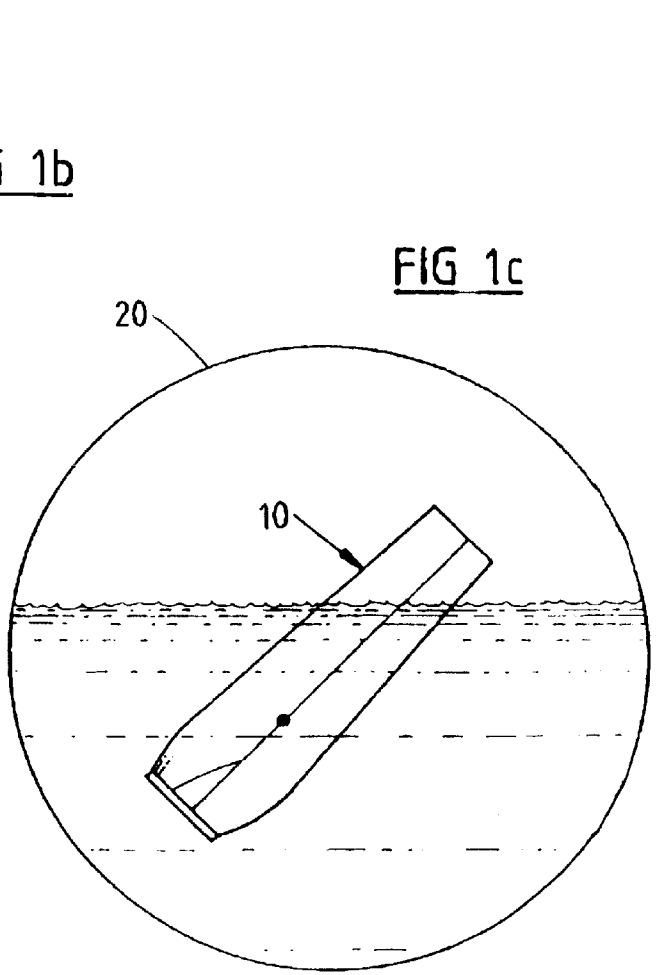
FIG. 1 is a diagram illustrating an exemplary method in accordance with the invention.
Figure 1B:
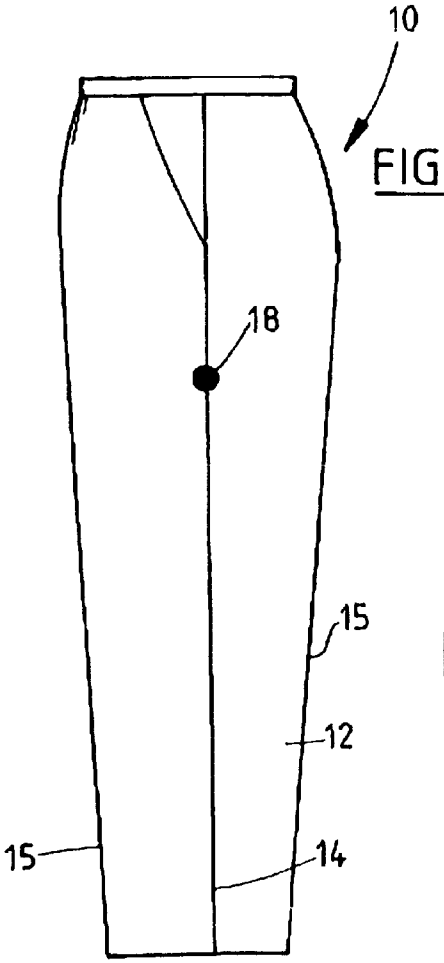
Figure 1A:
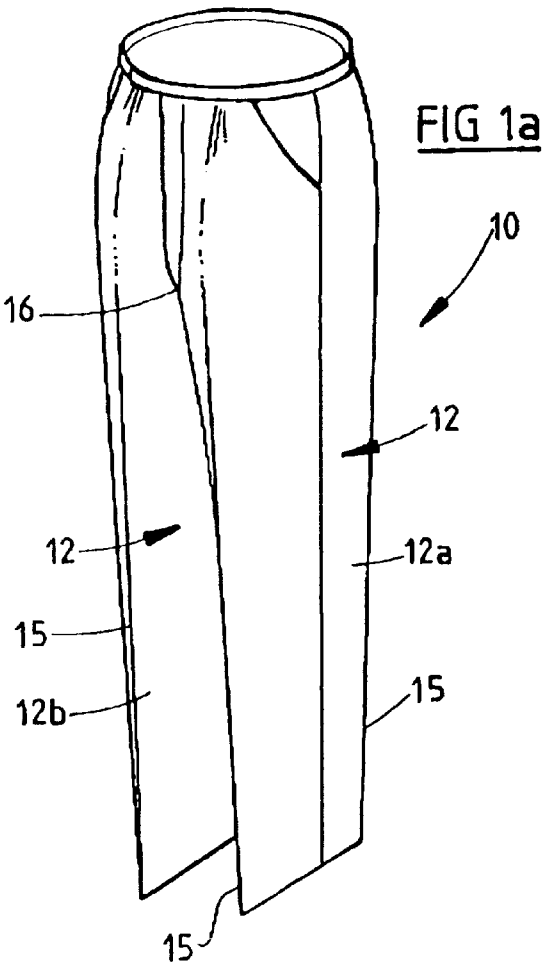
Figure 1E:
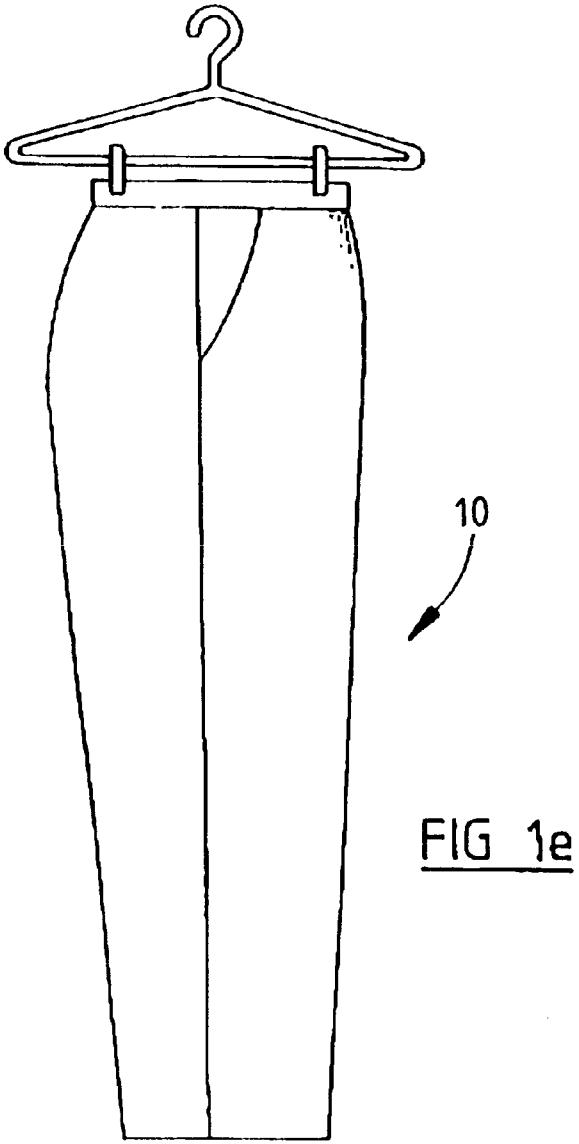
Figure 1D:
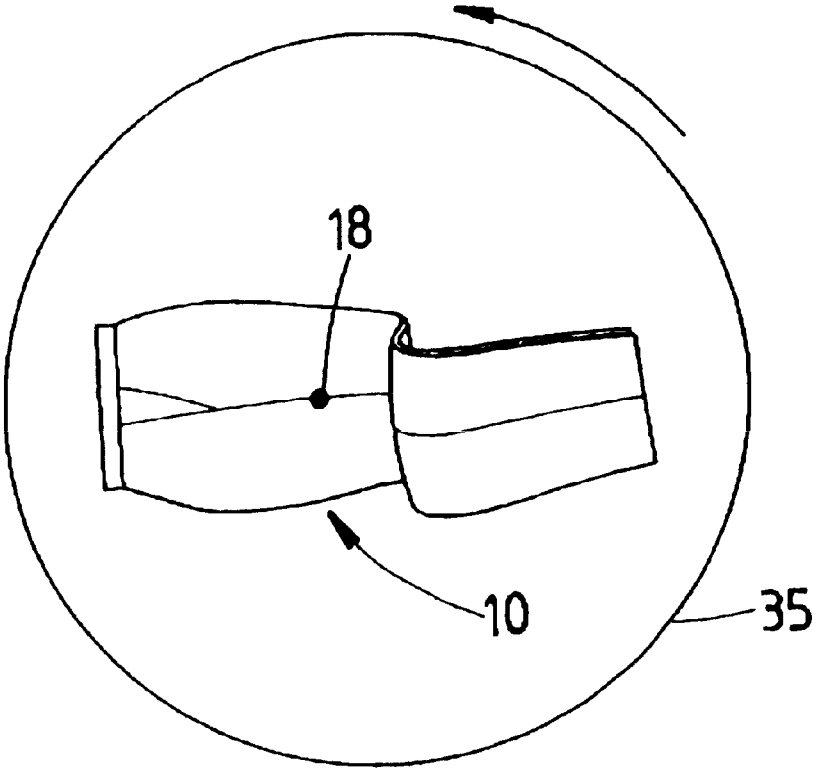
Figure 3C:
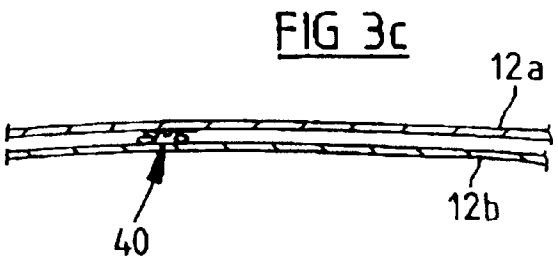
FIG. 3 is a diagram illustrating some exemplary attachment devices useful in practising the invention.
Figure 3D:
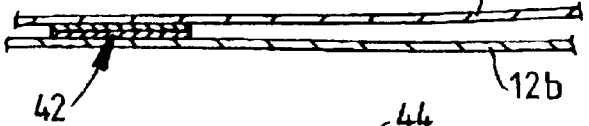
Figure 3E:
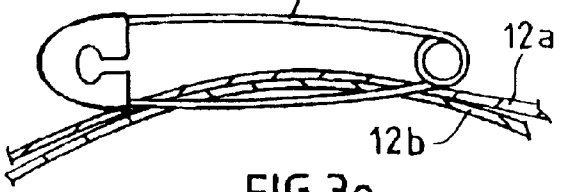

FIG. 1 illustrates an exemplary method of the invention applied in a process for laundering the trousers 10 shown at FIG. 1(*a*). The trousers 10 are of conventional form having legs 12, each of which has an outside 12*a* and an inside 12*b*. In this process, the trousers 10 are laundered by placing them in a washing machine (FIG. 1(*c*)) so that the trousers are subjected in the washing machine, to a conventional cycle of laundering or washing treatment such as initial wetting by introduction of water into the washing machine, introduction of washing powder into the water, accompanied by agitation of the liquid and trousers to effect washing, followed by a rinsing cycle and possibly a spin drying cycle. Next, as shown at FIG. 1(*d*) the trousers are dried in a rotary rumble dryer 35, after which they may be hung such as shown in FIG. 1(*e*).

In the particular method of this invention illustrated in FIG. 1 the trousers are, as shown in FIG. 1(*b*), first processed, before placing them in the washing machine. This processing includes attaching the inside and the outside of each leg of the trousers at respective aligned locations adjacent to a crotch region 16 thereof. A single attachment means 18 such as, for example, a staple or pin is in this case provided to effect this attachment. In particular, the inside and outside of each leg are brought into and maintained in close proximity by this means. The insides of the two legs are also so attached to each other, although this is not necessary for practicing the invention. After this attachment, the trousers are, as described, subjected to the laundering or washing treatment described, with the device 18 still in position and then to the described tumble drying treatment, with the device 18 also still in position. Hanging, as shown at FIG. 1(*e*), may be effected either before or after drying in the tumble dryer is complete.

It has been found that by this expedient, creases 15 at the front and rear edge of each trouser leg tend to be well maintained instead of being degraded as usually occurs during laundering in a process such as described in FIG. 1.

Generally, the inside and outside of the legs are attached during at least a substantial period of time during which drying occurs, that is for a time period sufficient that, after release of attachment, no substantial loss of shape of the trousers occurs.

In the described arrangement, the trouser legs are each pinned at corresponding locations at a single device 18, although they could be separately pinned by separate devices 18 at separate locations, each however in the crotch region above described.

Although rumble drying has been described, drying may be effected in other ways such as hanging the trousers, such as in a heated drying cabinet.

Figure 2:
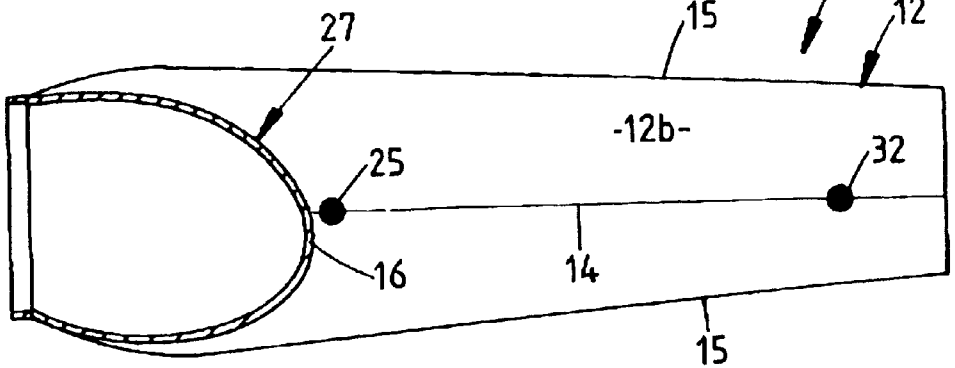
FIG. 2 is a sectional view of trousers, illustrating preferred locations for attachment of inner and outer sides of respective legs thereof.
Figure 3A:
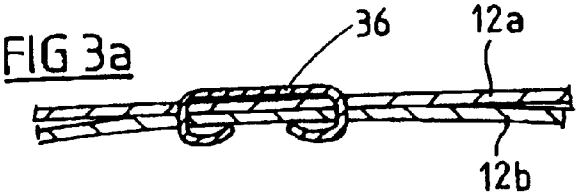
Figure 3B:
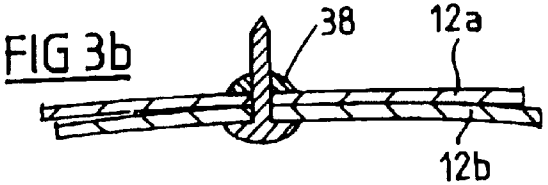

As shown in FIG. 2, the attaching may be effected at a location 25 at the base of the crotch or slightly below this, preferably somewhat midway between the creases 15 if the trousers, such as on side seams 14 of the trousers. The positioning should usually be within a radius of about 20 cm, preferably about 10 cm from the base of the crotch 16 on or below the partition seam between the legs and defining the crotch. The location 25 at which attachment occurs may be on the crotch defining partition seam 27 between the legs 12. While it has been found that constraint at or near the crotch location is sufficient, some improvement may further be achieved by attachment at other locations away from the primary location, such as at the location 32 shown towards the bottoms of the trousers, again however preferably substantially midway between the creases 15.

The affixation may be effected by any suitable attachment means. FIGS. 3(*a*), (*b*), (*c*), (*d*) and (*e*) illustrate affixment by the use of, respectively, a staple 36, a plastics tag 38, a simple hook and eye connector 40 comprising an eye attached to the inside of one leg and a hook attached to the other, hook and eye material 42 on the inner surface of the inside and outside of each leg 12, (such as material sold under the trademark VELCRO), or a safety pin 44.

In general, the attachment means may be removable or have components which are removable and may be temporarily affixed during processing. However, for example where materials such as Velcro or small internal connectors having releasable components are used, these may be left permanently in place on the garment.

The invention may be practised, generally, in any case where trousers are subjected to processing by a fluid such as a liquid, including in the manufacture of trousers. It is particularly effective in situations where the garment is, by the processing, subjected to relatively unconstrained movements, such as tumbling, which would generally tend to cause loss of shape of the trousers. Thus, the invention is so effective in cases where the garment is subjected to agitation.

It is thought that the effectiveness of the invention arises because, during such processing, there is a reduced tendency for occurrence of cohesive setting due to contact as between random portions of the trouser legs. Instead, cohesive setting tends more to occur simply between aligned portions of the inside and outside of the legs. Alternatively, the effectiveness of invention may be due to reduction of stress on the crease.

Generally, a principal feature of shape of trousers which practising the invention tends to maintain is creases. However, other features of shape may be so maintained for example, seam flatness or smoothness.

The following examples are illustrative of applications of the invention.

EXAMPLE 1

A plain-weave shrinkresist all-wool fabric was made up into ladies' trousers. The creases were sprayed with setting chemical, and the trousers then pressed while creases still wet, for a 30 seconds steam, 30 second bake cycle. Prior to washing (domestic permanent press cycle) and tumble drying, a safety pin was inserted near the crutch in one leg, so that two layers of fabric were held together at the seams.

After washing and tumble drying, the crease in the constrained leg was clearly superior to the free, control leg, as shown in the ratings (1–5 scale, 5 excellent, 1 poor) as set out below:

| | RATINGS* | |
|---|---|---|
| CYCLES | Unconstrained | Constrained |
| 0 (before washing) | 5 | 5 |
| 1 | 3 | 5 |
| 5 | 2 to 3 | 4 to 5 |
| 6** | 3 to 4 | 4 to 5 |

*AATCC ratings (ratings in accordance with a standard of the American Association of Textile Chemists and Colorists)

Thus, attaching the inside and outside of a trouser leg, during washing and tumble drying, produced a marked improvement in crease rating.

EXAMPLE 2

In a commercially obtained wrinkle free pair of cotton trousers, and a pair of 60/40 wool/polyester blend trousers, a pin was inserted on one leg (termed the constrained leg) on the outside seam approximately 50 mm below the crutch so that the outside and inside of the leg were attached at this point. The trousers were washed and tumble dried in a domestic machine five times and allowed to recondition overnight to a standard atmosphere. The creases of each leg were rated* for sharpness.

| Fibre Composition | Type | Crease Rating* |
|---|---|---|
| 100% Cotton | unconstrained | 2 to 3 |
| | constrained | 3 |
| 40% Wool/40% PE | unconstrained | 3 |
| | constrained | 4 to 5 |

*AATCC ratings

Thus, there was a small but significant improvement in the crease sharpness in trousers made of fibres other than all wool.

EXAMPLE 3

A pair of shrinkresisted all-wool trousers were set by spraying the creases with setting solution and pressing, while wet, for a cycle of 30 seconds steam, 30 seconds bake. a safety pin was inserted in one leg near the crutch, so that the two fabric layers were pinned together, with the creases in alignment. The trousers were then immersed in water containing a small amount of detergent to assist wetting out, then spun to a low pick-up of 30% (to simulate the application of resin and/or softener from a rotary machine). The slacks were then dried in a tumble drier. The constrained leg was visibly sharper, (rating 5) so that no touch-up pressing would have been required before final curing. The free control leg, while retaining an acceptable crease, rating 3 to 4, was judged to have required a touch up press before the curing step.

This illustrates an application of the invention in garment treatment from aqueous rotary machines.

The following examples were conducted on simulated trouser leg samples, and demonstrate wider applications of the invention.

EXAMPLE 4

A pure wool fabric was treated with shrinkresist and setting agents and made up into trouser legs. Three garments were then steam pressed in a conventional trouser press to flatten seams and form creases. All were damped with a fine mist of water prior to pressing using a 10 second steam, 10 second bake and 10 second vacuum cycle. This steam pressing imparted permanent set to the wool fibres.

In each garment a pin was inserted on one leg of the trouser (termed the constrained leg) on the outside seam approximately 50 mm below the crotch so that the outside and inside of the leg were attached at this point. Two of the three garments were treated in a dilute solution of a reagent which stabilized the set in the wool, hydro-extracted to remove excess solution and tumble dried. The garment was then cured in an oven at 150° C. for five minutes. The permanent set imparted to the fabric was measured using snippets of yarn taken from the creases and released at 50° C. for 30 minutes. (Set %=(180−a)/180×100 where, "a" is the measured crease angle). The creases were rated after five laundering cycles as before.

| After-treatment | Curing | Crease Rating* | | Set % | |
|---|---|---|---|---|---|
| | | Unconst | Const | Unconst | Const |
| none | none | 1 | 5 | 22 | 56 |
| 1 g/1 hydrogen peroxide | none | 2 | 5 | 61 | 61 |
| Fixappret FK5 | 150 | 3 to 4 | 5 | 67 | 61 |

*AATCC ratings

The chemical aftertreatments improved the set retained in laundering (unconst. column), and this also improved the crease rating (unconst. column), but there was a further improvement to the maximum rating of 5 when the trouser leg was constrained by attaching the inside and outside of each leg as described.

Thus, the constraint improved the appearance of the garment after washing and drying and contributed an additional effect to that achieved by a separate chemical aftertreatment of the garment in a rotary machine.

EXAMPLE 5

A pure wool fabric was treated with shrinkresist and setting agents and made up into trouser leg samples. Four pairs were then steam pressed in a conventional trouser press to flatten seams and form creases. Two pairs were damped with a fine mist of water prior to pressing using a 10 second steam, 10 second bake and ten second vacuum cycle. The remaining two pairs were also damped but then pressed for a 30/30/10 cycle. This steam pressing imparted permanent to the wool fibres. One of each of thee pairs were then sprayed with hydrogen peroxide solution. The set imparted was calculated from crease angle measurement.

In each of the four pairs, a pin was inserted in one leg (termed the constrained leg) near the top, corresponding to the crotch in full trousers, so that the outside and inside of the leg were attached at this point. The trouser legs were washed and tumble dried five times and allowed to recondition overnight to a standard atmosphere. The creases of each leg were rated for sharpness and measured for set by the crease angle method.

The table shows that a rating of 5 was achieved in all cases when constrained was applied. While hydrogen peroxide improved both set and crease rating, it was less effective than constraint, particularly at the shorter pressing time.

| Press | Peroxide | Not constrained | | Constrained | |
|---|---|---|---|---|---|
| Time | (spray) | Rating | Set % | Rating | Set % |
| 10/10 | No | 2 | 39 | 5 | 39 |
| 10/10 | Yes | 4 to 5 | 72 | 5 | 72 |
| 30/30 | No | 4 | 72 | 5 | 72 |
| 30/30 | Yes | 4 to 5 | 78 | 5 | 78 |

Thus, attaching to inside and outside of constrained leg provides scope for reducing the steam pressing time that is normally required, and also for eliminating the extra operation of spraying with a set stabilising agent.

EXAMPLE 6

A pure wool fabric was treated with shrinkresist resin and setting agents and made up into a garment. The garment was then stream pressed using a 10 s steam, 10 s bake and 10s vacuum cycle. a plastic tag from a tagging gun was then inserted into one leg near the crotch so that the outside and inside of the leg were attached at this point. The trouser was then tumbled in a rotary machine for 30 minutes in which steam was injected to maintain the temperature at 100° C. for 30 minutes. The creases of the constrained leg showed excellent sharpness compared to poor sharpness of the unconstrained leg.

This demonstrates that the use of the constraint can eliminate the need for long wet pressing times required using the conventional route (see Example 5).

EXAMPLE 7

A pure wool fabric was treated with shrinkresist resin (not cured) and setting agents and make up into a garment. The garment was then steam pressed using a 10 s steam, 10 s bake and 10 s vacuum cycle to cure the resin in the creases state and give a small amount of stability to the formed crease. A safety pin was then inserted adjacent the crotch and also at the cuffs of each leg to hold the inside and outside of the trouser together. The trouser was then dyed in a rotary dyeing machine for 60 minutes in the presence of an anti-setting agent (Basolan AS) to stabalise any set imparted. After dyeing the garment was removed, the constraints removed and the garment machine washed and tumble dried five times (without the constrain). The creases were then rated for sharpness and found to give the top rating of 5. a control garment without the constraint during dyeing was rated at only 2.

This example clearly shows the benefit of application of the invention in garment processing.

Generally, attachment of the inside and outside of a trouser leg, in accordance with this invention, involves constraining aligned portions of these such that those portions are maintained in close proximity.

The term "trousers" as used in the is specification is to be understood in a general sense, including for example, shorts and slacks, culottes, and any garment having a generally tubular portion for accommodating the leg of a person and a portion to which the generally tubular portion joins. The term "trousers" is to be understood as also including partly formed trousers, such as partly formed trousers having one or more legs attached to a portion which is or is to define a waist or groin portion of the trousers. The invention, including the exemplary method or process steps described above as being applicable to trousers, may also be applicable to other garments where a generally tubular portion is designed for purposes other than accommodating the leg. For example, it may be applied to the sleeves of shirts. Usually, the generally tubular portion is creases, and the improvement in stability of shape of the garment arising from use of the invention is in connection with maintenance of opposed lengthwise extending creases. However, as mentioned, stability may be improved with respect to other features of shape as well.

The described forms of the invention have been advanced merely by way of explanation as many modifications may be made thereto without departing from the spirit and scope of the invention which includes every novel feature and combination of novel features herein disclosed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

What is claimed is:

1. A method for improving the stability of the shape of partly or fully formed trousers subjected to a process including treatment with a medium and subjecting the trousers to movements tending to cause the trousers to lose shape, wherein the trousers have a crotch region and each leg of the trousers has an inner leg portion arid an outer leg portion and wherein, during at least part of the process the inner and outer leg portions of at least one leg of the trousers are attached to each other at a location on or adjacent the crotch region of the trousers.

2. A method as claimed in claim 1, wherein said medium is a solvent, gas, steam or water.

3. A method as claimed in claim 1, wherein said movements are uncontrolled.

4. A method as claimed in claim 1, wherein said process includes drying the trousers.

5. A method as claimed in claim 4, wherein said drying includes tumble drying.

6. A method as claimed in claim 4, wherein said attaching prevails at least during a substantial part of the time during which the trousers are subjected to said drying.

7. A method as claimed in claim 1, wherein said location is within 20 cm of the crotch region.

8. A method as claimed in claim 7, wherein said location is within 10 cm of the crotch region.

9. A method as claimed in claim 1, wherein the location is on a partition of the trousers within the crotch region.

10. A method as claimed in claim 1, wherein said location is substantially midway between opposed creases of said at least one leg.

11. A method as claimed in claim 1, wherein said location is substantially on a side seam of said at least one leg.

12. A method as claimed in claim 1, wherein the attachment is effected by use of attachment means which is positioned on the trousers.

13. A method as claimed in claim 11, wherein said attachment means is positioned on the trousers prior to subjecting the trousers to said treatment with a medium.

14. A method as claimed in claim 11, wherein the attachment means is in position on the trousers after subjecting the trousers to said treatment with a medium.

15. A method as claimed in claim 11, wherein the attachment means, or at least a component thereof, is attached before said process is effected and removed subsequently.

16. A method as claimed in claim 1, wherein the inner and outer leg portions of the at least one leg are attached only at said location.

17. A method as claimed in claim 1, wherein the inner and outer leg portions of the at least one leg are attached at a further location, spaced away from the crotch region.

18. A method as claimed in claim 1, wherein the process is or includes laundering or washing the trousers.

19. A method as claimed in claim 1, wherein the process is or includes a process in manufacture of the trousers.

20. A method as claimed in claim 1, wherein, following said process, the trousers are treated with a chemical aftertreatment for improving stability of the shape of the trousers.

21. A method as claimed in claim 1, wherein the trousers are subjected to pressing after said process.

22. A method as claimed in claim 21, wherein the attachment of the inner and outer leg portionsof the or each trouser is released after said pressing.

23. A method as claimed in claim 21, wherein the attachment of the inner and outer leg portions is released before said pressing.

24. A method as claimed in claim 1, wherein the inner and outer leg portions of each of two legs of the trousers are attached during at least part of said process at respective said locations.

25. A method as claimed in claim 24, wherein said locations are aligned.

26. A method as claimed in claim 25, wherein the attachment is effected by an attachment means which comprises a single attachment device which attaches the inner leg portion to the outer leg portion of each leg.

27. A method as claimed in claim 1, in which the trousers are formed from wool, cotton, silk, regenerated or other cellulosic fibres, or nylon, polyester or other synthetic fibres, or any blend of any one or more of these with other fibres, or other fibrous material.

28. A method as claimed in claim 1, wherein the trousers are formed from one or more material which softens under action of water, steam, solvent and/or heat.

29. A method as claimed in claim 1, wherein the trousers are formed from one or more materials selected from the group comprising protein fibres, regenerated or other cellulosic fibres, nylon, polyamide or other synthetic fibres.

30. A method as claimed in claim 1, wherein said material includes a substantial proportion of wool and/or cotton.

31. A method of laundering trousers, including subjecting the trousers to movements tending to cause the trousers to lose shape, in which, during the laundering, the trousers have applied thereto an attachment means which attaches inner and outer leg portions of each leg of the trousers to each other at a respective location on or adjacent to the crotch of the trousers.

32. A method of laundering or washing trousers, including subjecting the trousers to movements tending to cause the trousers to lose shape, in which, during the laundering or washing, inner and outer leg portions of each leg of the trousers are attached to each other at respective locations on or adjacent the crotch of the trousers.

33. A method as claimed in claim 32, wherein the attachment is effected before the process and subsequently removed.

34. Partly or fully formed trouser is subjected to movements tending to cause the trousers to lose shape and having inner and outer leg portions of at least one leg of the trousers attached to each other at a respective location on or adjacent a crotch region of the trousers.

35. Partly or fully formed trousers subjected to movements tending to cause the trousers to lose shape and having attachment means for attaching inner and outer leg portions of each leg of the trousers to each other at respective locations on or adjacent to a crotch region of the trousers.

36. A method for improving the stability of the shape of the garment of the kind having a generally tubular part appendant to another region of the garment and which garment is subjected to a process including treatment with a medium and subjecting the garment to movements tending to cause the garment to lose shape wherein, during the process, opposed wall portions of the generally tubular part are attached to each other at a location adjacent to a junction between the tubular part and the another region.

37. A method as claimed in claim 36, wherein the tubular part has opposed lengthwise creases between which the opposed portions extend.

* * * * *